United States Patent [19]

Minard et al.

[11] Patent Number: 4,714,054

[45] Date of Patent: Dec. 22, 1987

[54] MOISTURE TRAP FOR A MOISTURE SEPARATOR REHEATER

[75] Inventors: Paul G. Minard; James Alba, both of Winter Springs; David A. Pacyna, Orlando, all of Fla.

[73] Assignee: Westinghouse Electric Corp., Pittsburgh, Pa.

[21] Appl. No.: 847,337

[22] Filed: Apr. 2, 1986

[51] Int. Cl.[4] ..... F22G 1/00

[52] U.S. Cl. ..... 122/483; 55/462; 122/488; 122/491

[58] Field of Search ..... 122/34, 459, 460, 469, 122/476, 483, 488, 489, 491; 55/462, 463, 465

[56] References Cited

U.S. PATENT DOCUMENTS 3,500,796 3/1970 Roffler ..... 122/34

3,713,278 1/1973 Miller et al. ..... 122/483 X 4,302,227 11/1981 Miller ..... 122/34 X 4,485,069 11/1984 Byerley ..... 122/483 X

*Primary Examiner*—Albert J. Makay

*Assistant Examiner*—Steven E. Warner

*Attorney, Agent, or Firm*—F. J. Baehr, Jr.

[57] ABSTRACT

A trough is formed above the moisture separators in a moisture separator reheater for a power plant and drain conduits are connected to the trough to direct moisture collected in the trough to the bottom of the shell where it joins other collected moisture and is drained from the lower portion of the shell via drain nozzles disposed therein preventing droplets from forming above the separator and dripping down into the flow path of motive steam, becoming reentrained, and resulting in erosion of the separators.

5 Claims, 3 Drawing Figures

MOISTURE TRAP FOR A MOISTURE SEPARATOR REHEATER

BACKGROUND OF THE INVENTION

This invention relates to moisture separator reheaters used in power plants and more particularly to a moisture trap disposed above the moisture separator portion.

Motive steam having done its work in a high pressure turbine is at reduced pressure and temperature so that it is laden with moisture. To remove the moisture and increase the temperature and thermal efficiency of the turbine unit the exhaust steam from the high pressure turbine is passed through a moisture separator reheater (MSR) to remove entrained moisture and reheat the dried steam before it is sent back to a lower pressure turbine to do additional work. The shell of the MSR is large so that some of the entrained moisture is separated from the motive steam as the steam swirls therethrough. Some of this separated moisture collects on plates disposed in the shell above the separator and drips down into the flow path of the steam entering the separator reentraining in the steam as shown in the attached drawing depicting prior art. The relatively large droplets have a tendency to erode the inlet portion of the moisture separator reducing its efficiency. U.S. Pat. No. 3,713,278 shows a moisture separator reheater with a cap over the ledge above the separator and U.S. Pat. No. 3,500,796 shows a trough on the side of horizontally disposed separators.

SUMMARY OF THE INVENTION

In general a moisture separator reheater, when made in accordance with this invention, comprises an elongated shell, a steam inlet for influent motive steam, a reheater tube bundle or bundles extending lengthwise in the elongated shell, a plurality of chevron shaped vanes disposed side by side to form moisture separating means to remove entrained moisture from the motive steam passing therethrough, and a plurality of plates cooperatively associated with each other, the shell, the tube bundles and the moisture separator to form a barrier between the steam inlet and the reheater tube bundles so that all of the motive steam passes over the chevron shaped vanes before entering the reheated tube bundle. At least one of the plates is disposed above the chevron shaped vanes and cooperates with an upwardly extending wall portion to form a trough disposed above the chevron shaped vanes to collect moisture separated from the motive steam as the motive steam flows through the shell from the steam inlet to the moisture separator. There is a drain nozzle in the shell and drain means are disposed in fluid communication with the trough so as to direct moisture collected in the trough to the drain nozzle in the shell and thereby prevent the moisture collected above the separator from forming droplets which drip down adjacent the inlet of the chevron shaped vanes and become reentrained in the motive steam to erode the inlet ends of the chevron shaped vanes.

BRIEF DESCRIPTION OF THE DRAWINGS

The objects and advantages of this invention will become more apparent by reading the following detailed description in conjunction with the accompanying drawings in which.

DESCRIPTION OF THE PREFERRED EMBODIMENT

Figure 2:
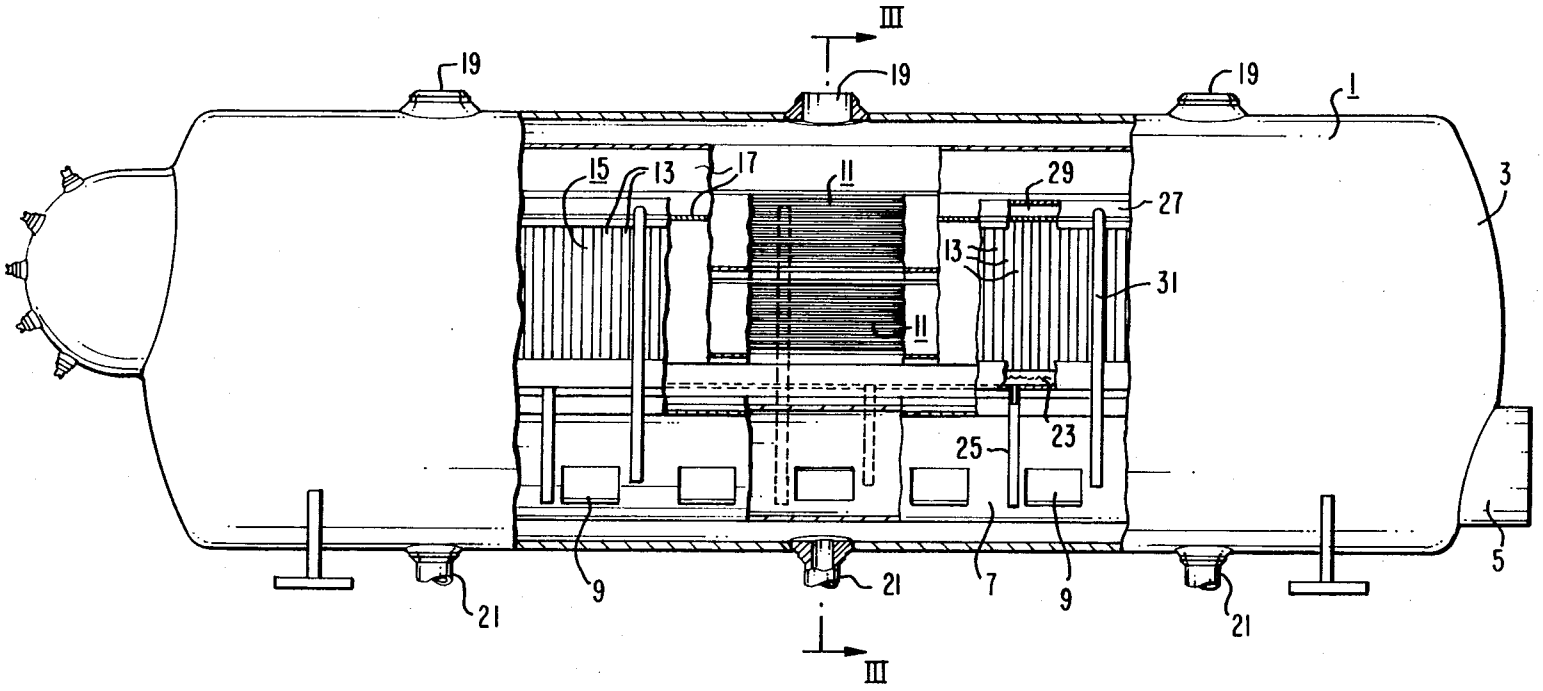
FIG. 2 is an elevational view partially in section of a moisture separator reheater made in accordance with this invention.
Figure 3:
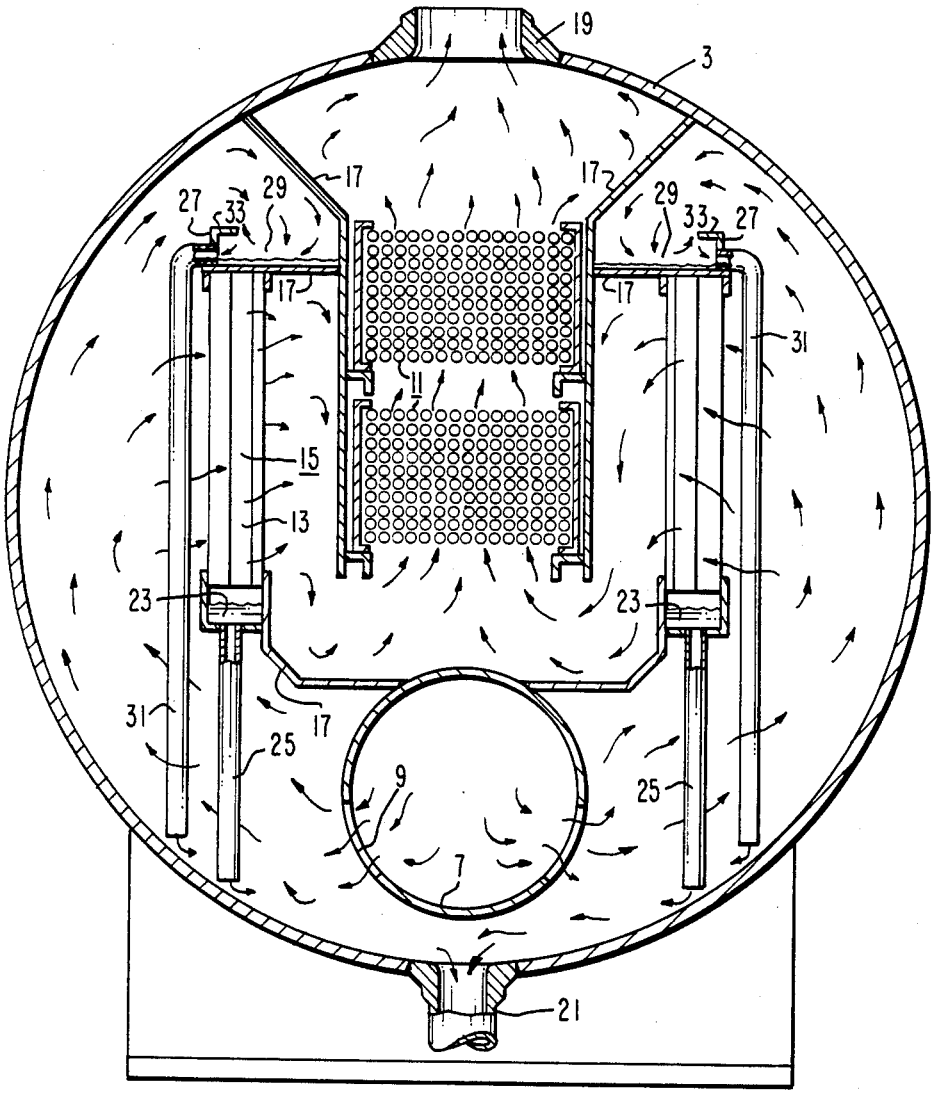
FIG. 3 is a sectional view taken on line III—III of FIG. 2.

Referring now to the drawings in detail where like reference numerals refer to similar party and referring im particular to FIGS. 2 and 3 which show a moisture separator reheater (MSR) 1 having an elongated shell portion 3, a steam inlet nozzle 5 through which motive steam is directed to a longitudinally extending manifold 7 disposed longitudinally in the shell 3 to distribute the motive steam via ports 9 throughout the length of the shell 3.

In the embodiment shown two reheater tubes bundles 11 extend lengthwise in the central portion of the shell 3 and a plurality of chevron shaped vanes 13 are disposed side by side on each side of the reheater tube bundles 11 forming a pair of moisture separators 15.

A plurality of plates 17 are disposed within the shell 3 and are cooperatively associated with each other, the shell 3, the manifold 7 and the moisture separator 15 to form a barrier within the shell 3 so that motive steam leaving the manifold 7 passes over the chevron shaped vanes 13 as it flows to the reheater tube bundles 11.

Outlet nozzles 19 are disposed in the upper portion of the shell 3 to allow the removal of dried reheated motive steam from the shell 3. The shell 3 also has a plurality of drain nozzles 21 disposed in the lower portion thereof to drain moisture removed from the motive steam from the shell 3.

The moisture separators 15 have a moisture collecting trough 23 disposed below the chevron shaped vanes 13 to collect the moisture removed from the motive fluid by the chevron shaped vanes 13. Drain pipes 25 are disclosed in fluid communication with the trough 23 to drain collected moisture to the lower portion of the shell 3 where the moisture drains from the shell via the nozzles 21.

Each separator 15 has at least one of the plates 17 disposed directly above it. An upwardly extending wall portion 27 is cooperatively associated with the last mentioned plate 17 to form a trough 29 above the separator 15 to collect some of the moisture swirled out of the moisture laden motive steam as it swirls in the shell prior to entering the separator 15. A conduit 31 or other drain means is disposed in fluid communication with the trough 29 and extends downwardly to the lower portion of the shell 3 to direct the moisture collected in the trough 29 to the lower portion of the shell 3 and the drain nozzles 21. The upper margin of the upwardly extending wall portion 27 of the trough 29 has a portion 33 which extends back over the trough 29 to prevent any droplets from being swept from the trough by the swirling motive fluid.

The operation of the MSR is as follows: moisture laden motive steam which has been expanded through one steam turbine enters the inlet nozzle 5 and flows through the manifold 7 and ports 9 into the lower portion of the shell 3. The motive steam flows upwardly along the wall on both sides of the shell 3. The majority of the moisture laden steam enters the space between the chevron shaped vanes 13 which cause it to follow a sinuous path to remove entrained moisture which flows down the separator vanes to the moisture collection trough 23 where it is drained by the drain pipe 25 to the lower portion of the shell and the drain nozzles 21. The dried steam then flows through the reheated tube bundle 11 wherein the dried steam is heated then it flows upwardly to the outlet nozzles 19 then through piping to a lower pressure turbine (not shown).

Some of the moisture laden steam flows above the separator 15 swirling before flowing downwardly to the separator vanes 13 and moisture is swirled out of this steam and collects in the trough 29 above the separator 15. The drain conduit 31 directs the moisture collected in the trough 29 to the lower portion of the shell 3 where it flows to the drain nozzles 21.

Figure 1:
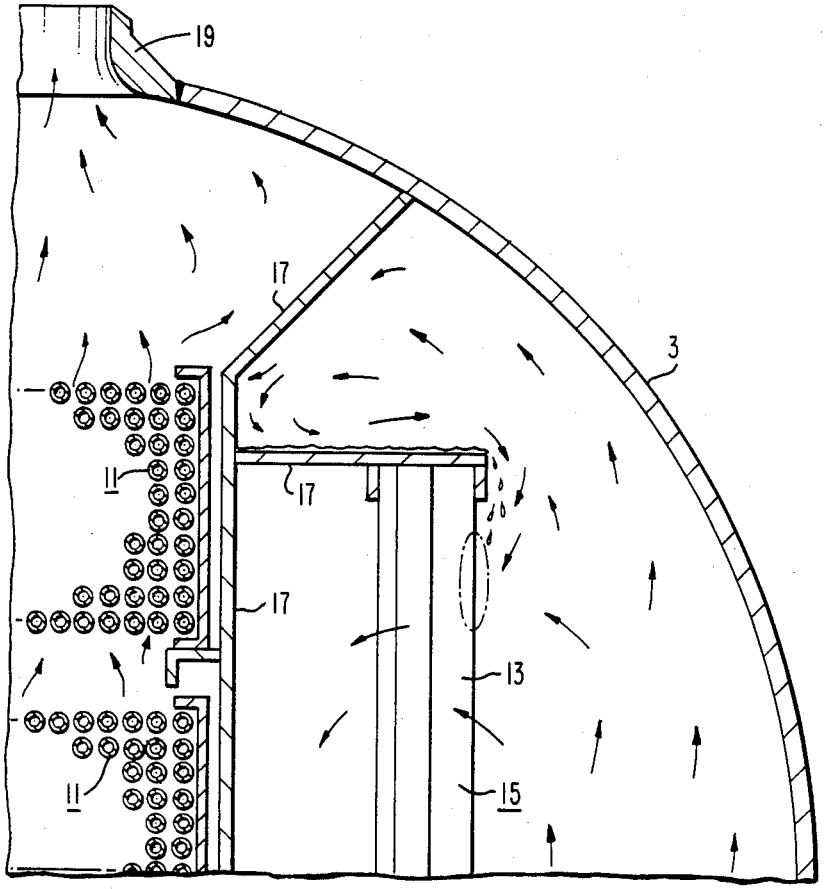
FIG. 1 PRIOR ART
FIG. 1 is a partial sectional view of a prior art moisture separator reheater.

As shown in FIG. 1, marked prior art, there is no trough 29 and moisture collected above the separator lays on the plates and drips off the edge thereof becoming reentrained in the motive steam about to enter the separator 15. The large droplet sizes which are formed when reentrained in the motive steam are extremely erosive and cause severe erosion of the separator vanes reducing their effectiveness as moisture separators.

What is claimed is:

1. A moisture separator reheater comprising:

an elongated shell;

a steam inlet for influent moisture laden motive steam;

a reheater tube bundle extending lengthwise in a central portion of the elongated shell;

a plurality of chevron shaped vanes disposed side by side to form moisture separating means to remove entrained moisture from the motive steam passing therethrough;

a plurality of plates cooperatively associated with each other, the shell, the tube bundle, and the moisture separator means forming a barrier between the steam inlet and the reheater tube bundle so that all of the motive steam passes over the chevron shaped vanes before entering the reheater tube bundle;

at least one of the plates being disposed above the chevron shaped vanes and having a vertically extending wall portion to form a trough disposed above the chevron shaped vanes to collect moisture separated from the moisture laden motive steam as the motive steam flows through the shell from the steam inlet to the moisture separator means;

the vertically extending wall portion of the trough having an upper margin disposed above any moisture collected therein and having an additional wall portion which extends from the upper margin back over a portion of the trough;

a drain in the shell; and draining means in fluid communication with the trough extending through the vertically extending wall portion and disposed to direct moisture collected in the trough to the drain in the shell and thereby preventing the moisture collected above the separator from forming droplets which drip down adjacent the inlet to the chevron shaped vanes and become reentrained in the motive steam thereby eroding the inlet ends of the chevron shaped vanes.

2. A moisture separator reheater as set forth in claim 1 wherein there is a second tube bundle disposed adjacent the first mentioned tube bundle.

3. A moisture separator reheater as set forth in claim 1, wherein the moisture separator has a plurality of chevron shaped vanes disposed side by side disposed in the shell on each side of the reheater tube bundle which is centrally disposed in the shell.

4. A moisture separator reheater as set forth in claim 3, wherein the steam inlet is connected to a manifold which generally extends the length of the shell and has a plurality of openings for distributing the motive steam throughout the length of the shell.

5. A moisture separator reheater as set forth in claim 4, wherein there is at least one plate having an upwardly extending wall portion to form a trough above the chevron shaped vanes on each side of the reheater tube bundle each upwardly extending wall portion having an upper margin disposed above any moisture collected therein and having an additional wall portion which extends from the upper margin back over a portion of the trough, and each trough has draining means in fluid communication therewith to direct the collected moisture to the drain in the shell.

* * * * *